US009775452B2

(12) United States Patent
Gibbons et al.

(10) Patent No.: US 9,775,452 B2
(45) **Date of Patent: *Oct. 3, 2017**

(54) MULTI-COMPONENT BODY PILLOW AND METHODS

(71) Applicant: The Boppy Company, LLC, Golden, CO (US)

(72) Inventors: Haley Gibbons, Wheatridge, CO (US); Eric Bradley Greene, Arvada, CO (US); Keith LaMar Poulson, Loveland, CO (US); Nancy Gale Hackett Harrison, Boulder, CO (US); Rachel Cynthia Carter, Denver, CO (US)

(73) Assignee: The Boppy Company, LLC, Golden, CO (US)

( * ) Notice: Subject to any disclaimer, the term of this patent is extended or adjusted under 35 U.S.C. 154(b) by 95 days.

This patent is subject to a terminal disclaimer.

(21) Appl. No.: 14/491,033

(22) Filed: Sep. 19, 2014

(65) Prior Publication Data

US 2015/0067966 A1 Mar. 12, 2015

Related U.S. Application Data

(63) Continuation of application No. 13/757,508, filed on Feb. 1, 2013, now Pat. No. 8,863,334.

(51) Int. Cl.
*A47C 20/02* (2006.01)
*A47C 16/00* (2006.01)
(Continued)

(52) U.S. Cl.
CPC ..... *A47G 9/1054* (2013.01); *A47C 20/021* (2013.01); *A47C 20/025* (2013.01);
(Continued)

(58) Field of Classification Search
CPC ..... A47C 20/02–20/025; A47C 16/00–16/02; A47C 20/27; A47C 7/45; A47D 13/083
See application file for complete search history.

(56) References Cited

U.S. PATENT DOCUMENTS 4,523,588 A 6/1985 Dolsky
4,901,384 A * 2/1990 Eary ..... A47C 20/021 5/632

(Continued)

OTHER PUBLICATIONS

Final Office Action dated Sep. 28, 2015 in U.S. Appl. No. 14/525,389, filed Oct. 28, 2014, 10 pages.

*Primary Examiner* — Nicholas Polito
*Assistant Examiner* — Ifeolu Adeboyejo
(74) *Attorney, Agent, or Firm* — Kilpatrick Townsend & Stockton LLP

(57) ABSTRACT

A pillow system includes a head pillow having a top end, a bottom end, and a connector disposed at the bottom end. A leg pillow has a top end, a bottom end, and sides extending between the top end and the bottom end. The leg pillow also includes a top connector at the top end, and a side connector at one of the sides. The connector of the head pillow is configured to be coupled to the top connector of the leg pillow. The pillow system also includes a torso pillow having a top end, a bottom end and two sides, and a connector disposed at one of the sides. The connector of the torso pillow is configured to be coupled to the side connector of the leg pillow.

16 Claims, 11 Drawing Sheets

(51) Int. Cl.
*A47G 9/10* (2006.01)
*A47C 20/00* (2006.01)

(52) U.S. Cl.
CPC ..... *A47C 20/027* (2013.01); *A47G 9/10* (2013.01); *Y10S 5/93* (2013.01); *Y10T 29/49826* (2015.01)

(56) References Cited

U.S. PATENT DOCUMENTS 5,269,323 A * 12/1993 Krouskop ..... A47C 20/021 5/632
5,313,678 A 5/1994 Redewill
5,499,418 A 3/1996 Tan
5,937,461 A * 8/1999 Dombrowski ..... A47D 15/003 5/632
5,978,990 A * 11/1999 Akey ..... A47C 20/021 5/631
6,182,311 B1 * 2/2001 Buchanan ..... A47C 20/021 128/845
6,499,164 B1 * 12/2002 Leach ..... A47C 20/021 5/630
6,708,354 B1 * 3/2004 Carter ..... A47D 13/083 128/845
7,089,614 B1 * 8/2006 Clapp ..... A47C 20/021 5/632
7,089,617 B1 8/2006 Lauro
7,540,050 B1 * 6/2009 Nazer ..... A47C 20/021 5/632
7,587,773 B2 * 9/2009 Littlehorn ..... A47C 16/00 5/632
8,074,310 B1 * 12/2011 Robbins ..... A47C 20/025 5/631
8,136,186 B1 * 3/2012 Leach ..... A47C 20/025 5/631
8,321,978 B1 12/2012 Fulton
8,418,295 B2 * 4/2013 Clark ..... A47D 13/083 5/632
8,448,275 B1 5/2013 Leach
9,021,635 B1 * 5/2015 Leach ..... A47C 20/02 5/630
2002/0050007 A1 5/2002 Kim
2004/0226096 A1 * 11/2004 Davis ..... A47C 16/02 5/632
2005/0060806 A1 * 3/2005 Wilkinson ..... A47C 20/021 5/632
2005/0229316 A1 10/2005 Liao
2006/0021146 A1 * 2/2006 Tokarz ..... A47C 20/021 5/632
2006/0042012 A1 * 3/2006 Littlehorn ..... A47C 20/021 5/632
2007/0067914 A1 * 3/2007 Littlehorn ..... A47C 16/02 5/632
2008/0052832 A1 * 3/2008 Racovolis ..... A47C 20/021 5/632
2008/0148487 A1 * 6/2008 Lord ..... A47C 20/021 5/632
2008/0222813 A1 * 9/2008 Aikman ..... A47C 20/021 5/632
2009/0313760 A1 * 12/2009 Blake ..... A47C 20/021 5/632
2010/0175192 A1 * 7/2010 Aiken ..... A47C 20/021 5/632
2010/0281617 A1 * 11/2010 Brun ..... A47C 20/02 5/632
2011/0119833 A1 * 5/2011 Clark ..... A47D 13/083 5/655
2012/0110742 A1 * 5/2012 Lawler ..... A61G 13/121 5/632
2012/0304387 A1 * 12/2012 Crompton ..... A47C 20/026 5/632

* cited by examiner

MULTI-COMPONENT BODY PILLOW AND METHODS

CROSS-REFERENCES TO RELATED APPLICATIONS

This application is a continuation of U.S. patent application Ser. No. 13/757,508, filed on Feb. 1, 2013, entitled "Multi-Component Body Pillow And Methods," the disclosure of which is hereby incorporated by reference in its entirety for all purposes.

BACKGROUND OF THE INVENTION

This invention relates generally to the field of pillows and, in particular, to pillows that may be used to support various parts of the body.

Pillows exist in a variety of shapes and sizes. Perhaps the most common type of pillow is generally rectangular and is filled with natural or synthetic materials. Such pillows are traditionally designed to support a person's head while lying in bed.

Another type of pillow is generally curved and has an interior well region. Such pillows have found use in supporting babies, when nursing, when sitting among others. Such pillows are described in U.S. Pat. Nos. 5,261,134, 5,661,861, 6,038,720, 6,055,687, 6,685,024, 6,434,770, 6,671,908, 6,532,612, 6,279,185, and 6,412,128, the complete disclosures of which are herein incorporated by reference.

A further type of pillow is a body support pillow that supports multiple parts of the body. An example of such a pillow is described in U.S. Pat. No. 7,810,191, the complete disclosure of which is herein incorporated by reference.

This invention is related to other types of pillow systems and methods for their assembly and use. These are more fully described below.

BRIEF SUMMARY OF THE INVENTION

The invention provides a variety of pillow systems and methods for their assembly and use. In one exemplary embodiment, a pillow system comprises a head pillow having a top end, a bottom end, and a connector disposed at the bottom end. A leg pillow has a top end, a bottom end, and sides extending between the top end and the bottom end. The leg pillow also includes a top connector at the top end, and a side connector at one of the sides. The connector of the head pillow is configured to be coupled to the top connector of the leg pillow. The pillow system also includes a torso pillow having a top end, a bottom end and two sides, and a connector disposed at one of the sides. The connector of the torso pillow is configured to be coupled to the side connector of the leg pillow.

In one aspect, the top end of the head pillow has a width that is greater than a width of at the bottom end. In one specific aspect, the head pillow has a maximum width near the top end in the range from about 12 inches to about 24 inches, and typically about 10 inches, a width at the bottom end in the range from about 6 inches to about 12 inches, and typically about 9 inches, a lateral length from the top end to the bottom end in the range from about 20 inches to about 36 inches, and typically about 28 inches, a longitudinal length from the top end to the bottom end in the range from about 12 inches to about 25 inches, and typically about 20 inches, a height at the top end in the range from about 2 inches to about 10 inches, and typically about 6 inches, a maximum height between the top end and the bottom end in the range from about 5 inches to about 12 inches, and typically about 8 inches, and a height at the bottom end in the range from about 1 inches to about 5 inches, and typically about 3 inches.

The head pillow may have a head region and a neck region. The neck region may be disposed at an angle in the range from about 35 degrees to about 65 degrees relative to the head region, and typically about 50 degrees. The neck region may optionally include a length of stitching that longitudinally bisects the neck region.

In a further aspect, the leg pillow has a generally straight upper section at the top end, with a width in the range from about 3 inches to about 10 inches, and typically about 7 inches, a length in the range from about 6 inches to about 18 inches, and typically about 13 inches, and a height in the range from about 1 inch to about 5 inches, and typically about 3.5 inches. The upper section may include a length of stitching that longitudinally bisects the neck section. Further, the leg pillow may include a lower section pillow that angles from the upper section by an angle in the range from about 15 degrees to about 50 degrees, and typically about 35 degrees, a lateral length in the range from about 30 inches to about 40 inches, and typically about 35 inches, a width in the range from about 10 inches to about 18 inches, and typically about 14 inches and an average height in the range from about 3 inches to about 9 inches, and typically about 6 inches. The leg pillow may have a longitudinal length from the top end to the bottom end in the range from about 40 inches to about 56 inches, and typically about 48 inches, and a lateral width from the bottom end to a far one of the sides in the range from about 20 inches to about 32 inches, and typically about 25 inches.

In one arrangement, the torso pillow is generally rectangular in geometry with rounded corners, wherein the torso pillow has a length in the range from about 14 inches to about 26 inches, and typically about 20 inches, a width in the range from about 6 inches to about 14 inches, and typically about 11.5 inches, and height in the range from about 1 inches to about 5 inches, and typically about 3.5 inches. The torso pillow may further comprise stitching offset from an outer periphery of the torso pillow.

In some cases, each of the head pillow, the leg pillow and the torso pillow comprise a fabric shell encasing a fibrous fill material. Also, the connector of the head pillow, the connector of the torso pillow, the top connector of the leg pillow and the side connector of the leg pillow may each comprise a hook and loop fastener material. Further, the system may include a clear package into which the head pillow, the leg pillow and the torso pillow are compressed. The clear package may include a handle. In one arrangement, the head pillow and leg pillow when connected form a C shape, and the torso pillow is generally disposed in an internal middle of the C.

The invention also provides an exemplary method of utilizing a pillow system. The method includes the step of coupling a head pillow to a leg pillow, where the head pillow has a top end, a bottom end, and a connector disposed at the bottom end. The leg pillow has a top end, a bottom end, and sides extending between the top end and the bottom end, a top connector at the top end, and a side connector at one of the sides. The connector of the head pillow is coupled to the top connector of the leg pillow. Also, a torso pillow is coupled to the leg pillow. The torso pillow has a top end, a bottom end and two sides, and a connector disposed at one of the sides. The connector of the torso pillow is coupled to the side connector of the leg pillow.

In some cases, the torso pillow is decoupled from the leg pillow. Also, the leg pillow may be decoupled from the head pillow and the torso pillow.

In one aspect, a user lays on the pillow system, with the user's head on the head pillow. The leg pillow is sandwiched between the user's legs and the torso pillow supporting the user's stomach. As another use, the user's head may be on the head pillow, with the leg pillow being sandwiched between the user's legs and the torso pillow supporting the user's back.

In a further use, a user lays with the leg pillow being sandwiched between the user's legs and the torso pillow supporting the user's stomach. Or, a user may lay with the user's head on the head pillow, and the torso pillow supporting the user's stomach.

DETAILED DESCRIPTION OF THE INVENTION

Figure 1:
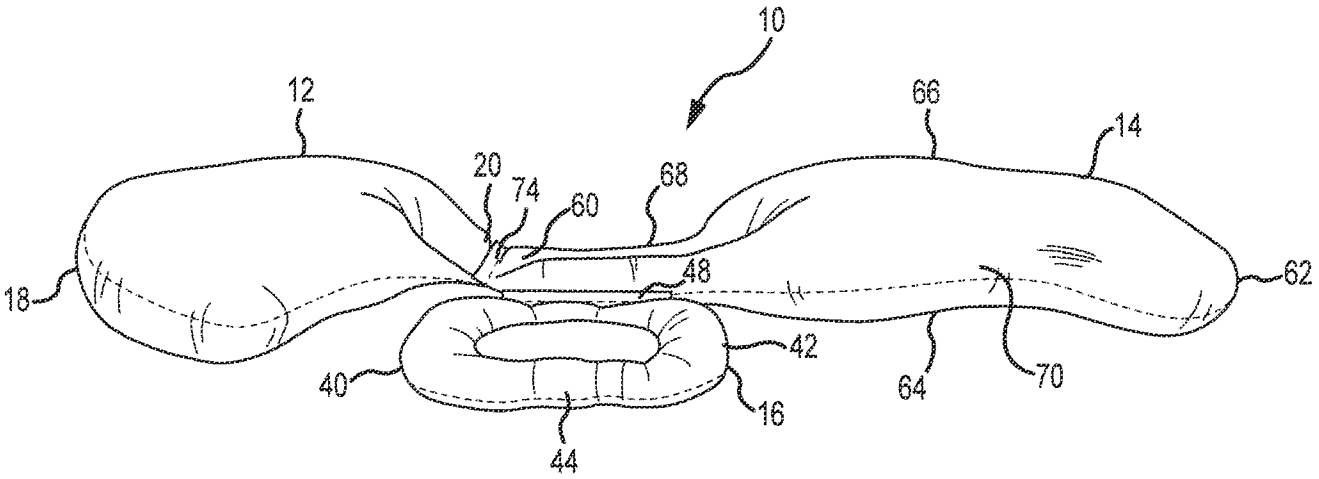
FIG. 1 is a perspective view of one embodiment of a pillow system according to the invention.
Figure 2:
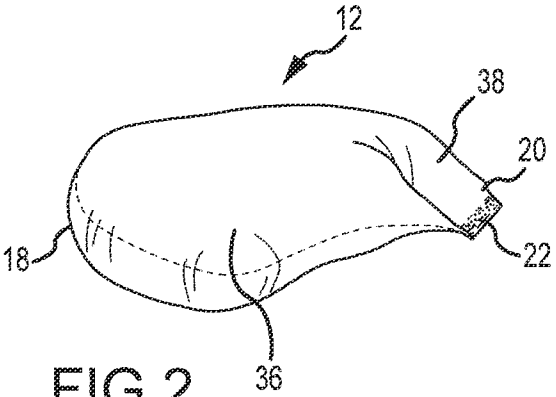
FIG. 2 is a perspective view of a head pillow of the system of FIG. 1.
Figure 3:
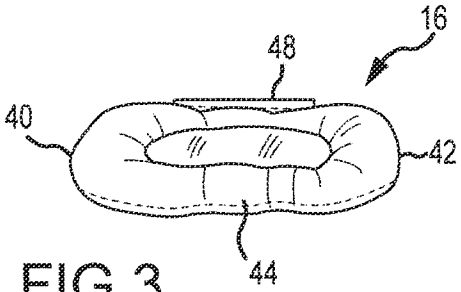
FIG. 3 is a perspective view of a torso pillow of the pillow system of FIG. 1.
Figure 4:
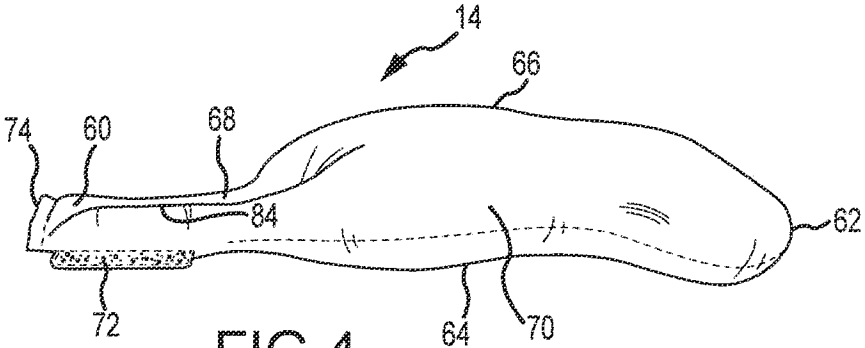
FIG. 4 is a perspective view of a leg pillow of the pillow system of FIG. 1.

The invention provides various body pillow systems and methods for their construction, assembly and use. One feature of the pillow systems is that they may be formed from multiple smaller pillows that are assembled in various configurations. In some cases, the pillows may be removably attached together to help maintain the pillows in a desired configuration. Merely by way of example, the pillow systems may include a head pillow that may be used to support a user's head, a leg pillow that may be used to support a user's legs (as well as portions of the legs, such as the thighs), and a torso pillow that may be used to support the user's torso, such as the stomach and/or back. In some cases the pillow systems may also take advantage of a traditional pillow, such as a fiber or feather filled traditional square or rectangular pillow.

The various pillows may be arranged and/or attached in a wide variety of configurations depending on the need for support. For example, the head, leg and torso pillows may be connected such that the resulting arrangement is somewhat C-shaped in geometry when lying on a flat surface, with the torso pillow being in the interior of the C-shaped. In this way, the torso pillow may be used to support the front of the person's body while lying down, with the head pillow supporting the head and the leg portion being placed between the knees to align the hips. Such a pillow may find particular use with a pregnant woman, where the torso pillow can be placed under the pregnant woman's belly to provide support, while the leg pillow serves to align the hips. In this way, the pregnant woman may lay on her side in a comfortable position while being supported by the pillows. It will be appreciated, however, that such a pillow system may be used with non-pregnant people as well, especially with people having back problems, those who are overweight, or who prefer to sleep on their side, among others.

This same configuration may also be used to support a person's back, with the torso pillow being located adjacent the person's back, while the leg pillow is positioned between the knees and the head pillow beneath the head.

In some arrangements, only two of the pillows may be connected, with the third pillow free to be placed in any arrangement, or else not used. For example, the head and leg pillow may be connected as described above, but the torso pillow not used, or else removed and placed in another location. As another example, the leg and torso pillows may be connected to support the user's legs and hips in combination with the stomach or back. In some cases, this arrangement could be used with a traditional head pillow that is not coupled to the other pillows.

In other arrangements, only two pillows may be used, but are not connected together. This provides further flexibility in arranging the pillows. For example, the head pillow may be used to support the head while the torso pillow is used to support the stomach or back. In further arrangements, none of the three pillows may be connected, but may be arranged in various configurations depending on the user's needs. For instance, the head pillow alone could be used to support the head, the leg pillow alone to support the legs or hips and/or the torso pillow alone to support the stomach or back.

Further, as each of the pillows has different shapes and thickness, the pillows could be interchanged such that the head pillow or torso pillow may be placed between the knees and thighs, the torso pillow or leg pillow used to support the head, or the leg pillow used to support the torso or head.

The pillows may conveniently be constructed of a resilient cushioned body which may be constructed of a fill material, such as a polyester filling or fibers, that are encased within a fabric shell. Other kinds of materials may be used, however, including, polybeads, natural materials, feathers, fluids, seeds, beans, and the like. In some cases, the fill material could comprise a fluid, such as air, that is enclosed within an inflatable bladder. The fabric shell may comprise essentially any type of fabric, such as a cotton fabric, polyester fabric, nylon fabric, or the like. Techniques for constructing the pillows may be similar to those described in U.S. Pat. Nos. 7,801,191, 7,089,639, 5,261,134, 5,661,861, 6,038,720, 6,055,687, 6,685,024, 6,434,770, 6,671,908, 6,532,612, 6,279,185, and 6,412,128, the complete disclosures of which are herein incorporated by reference.

In some cases, a removable slipcover which fits snugly around the shape of the pillow body may be provided. This slipcover may have one or more openings that allow the pillow to slide into it. Further, one or more fasteners may be used to close these openings, such as zippers, ties, snaps, a hook and loop fastener material, and the like.

The pillows may also have a firmness that permits them to be soft and malleable so that they can be formed to the individual comfort of the user, yet firm enough so that they provide adequate support. Also, the pillows may have different levels of firmness. For example, the torso pillow may be more firm than the head pillow. Also, some of the pillows may include regions of internal stitching that extend through the body of the pillow. This helps to increase firmness, dictate shape and prevent the fill material from shifting in the pillow. For example, the pillows may optionally include one or more seams that extend across portions of the pillow body. These seams may simply be a sewn line that extends across the pillow body and may be used to prevent the fill material from migrating within the pillow. In some cases, multiple seams may be placed within the pillows to provide such benefits. As another option, one or more internal baffles or fabric walls may be placed inside the fabric shell to prevent the migration of the fill material.

A wide variety of connectors may be used to couple the various pillows together. For example, one or more sections along an outer edge of the pillows could include a length of a hook and loop fastener material to permit the pillows to be coupled together. Examples of other connectors include buttons, ties, straps, clips, hooks, and the like.

Figure 19:
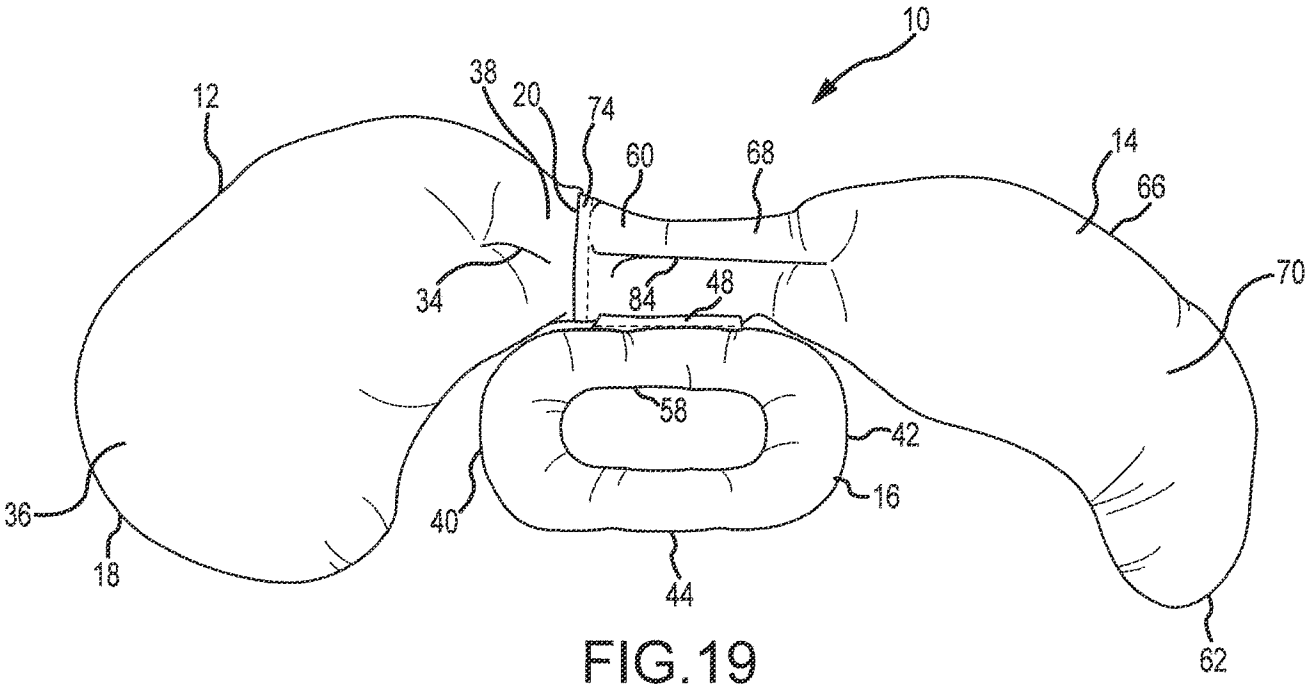
FIG. 19 is a top view of the pillow system of FIG. 1.
Figure 20:
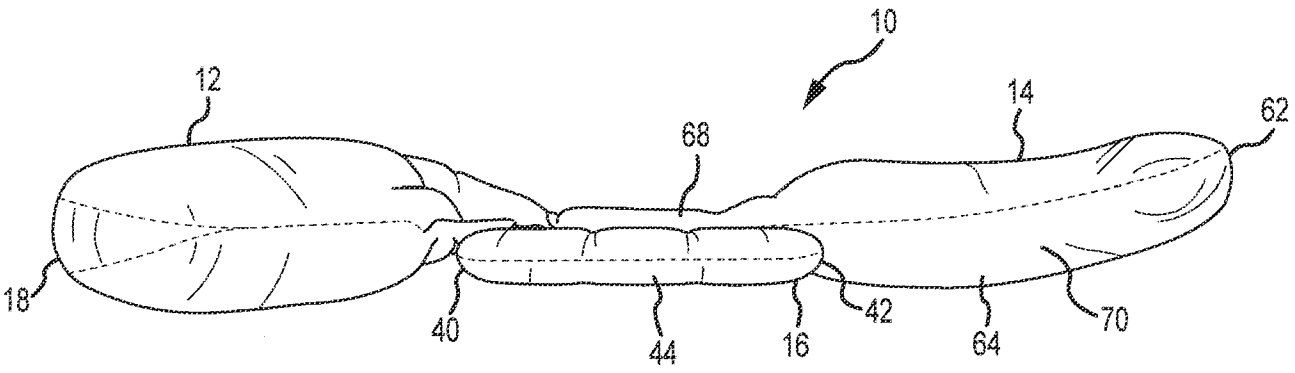
FIG. 20 is a side view of the pillow system of FIG. 1.
Figure 21:
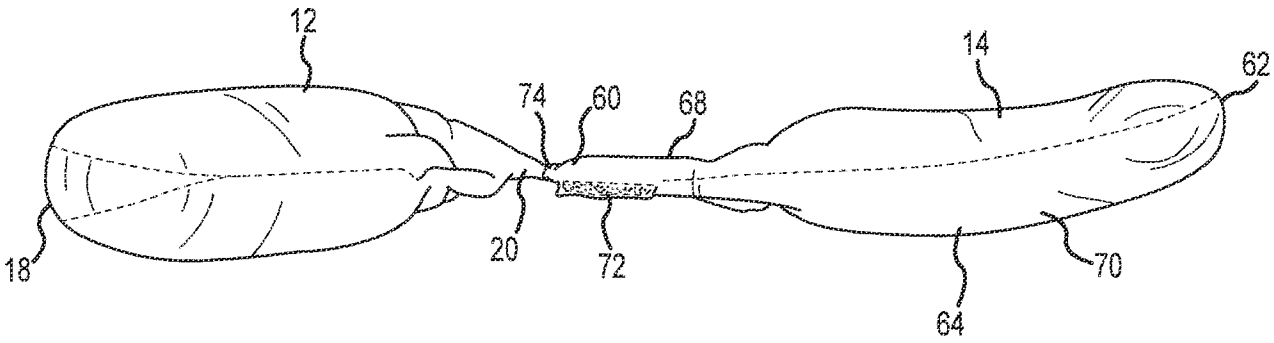
FIG. 21 is a side view of the pillow system of FIG. 20, with the torso pillow being removed.

Referring now to FIGS. 1, 19 and 20, one exemplary embodiment of a pillow system 10 will be described. Pillow system 10 includes a head pillow 12, a leg pillow 14 and a torso pillow 16. In use, head pillow 12 is generally used to support a user's head while leg pillow 14 is generally used to support a user's legs and/or hips, often by positioning leg pillow 14 between the user's knees and/or thighs. Torso pillow 16 is generally employed to support a person's torso, typically by supporting the stomach or lower back. As described hereinafter, various types of connectors may be used to removably couple head pillow 12, leg pillow 14 and torso pillow 16 together in the configuration illustrated in FIGS. 1, 19 and 20. However, the various pillows may be coupled together (or arranged relative to each other without connecting them together) in a variety of arrangements. Merely by way of example, and as shown in FIG. 21, torso pillow 16 could be removed from leg pillow 14 so that head pillow 12 is only coupled to leg pillow 14. Other arrangements are possible.

Figure 9:
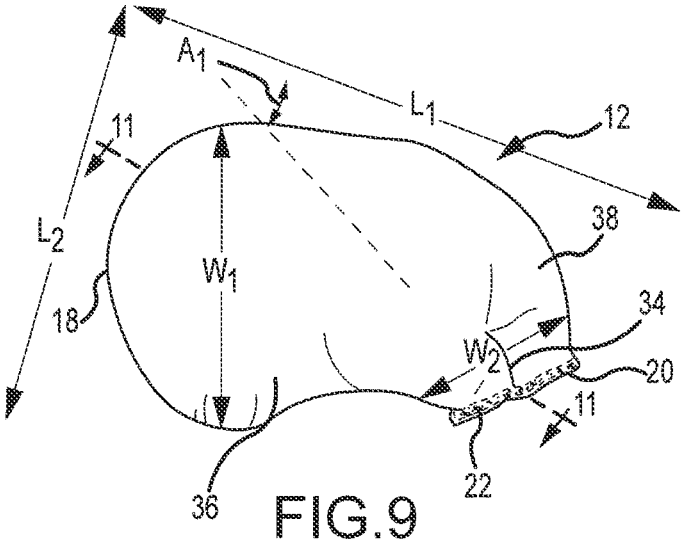
FIG. 9 is a top view of the head pillow of FIG. 1.
Figure 10:
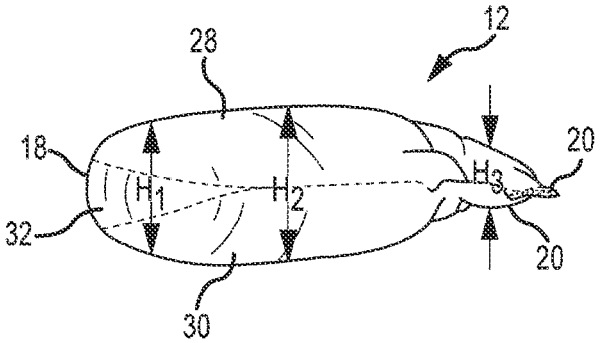
FIG. 10 is a side view of the head pillow of FIG. 9.
Figure 11:
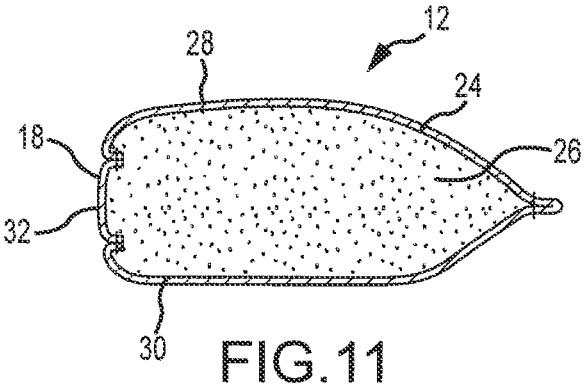
FIG. 11 is a cross-sectional side view of the head pillow of FIG. 9 taken along lines 11-11.

Referring also now to FIGS. 2 and 9-11, construction of head pillow 12 will be described in greater detail. Head pillow 12 may be conveniently defined in terms of a top end 18 and a bottom end 20. A strip of connector material 22 is included at bottom end 20 to permit head pillow 12 to be coupled to the other pillows of pillow system 10. As best shown in FIG. 11, head pillow 12 (as well as the other pillows described herein) may be constructed of an outer fabric shell 24 which encases or encloses a fill material 26. Fabric shell 24 will typically be constructed of a soft and flexible fabric, such as a cotton or polyester/cotton blend. However, any of the fabrics described herein may be used. Similarly, fill material 26 will typically comprise a polyester filling or fibers but may alternatively include any of the fill materials described herein. Fabric shell 24 may conveniently be constructed from three pieces of material, a top piece 28, a bottom piece 30 and a side piece 32, although in some cases two pieces could be used. These pieces may be coupled together using thread that is stitched or sewn using appropriate equipment, such as a sewing machine. Connector material 22 may comprise a hook and loop fastener material which is coupled to bottom end 22. However, it will be appreciated that other connectors may be used as described herein. As best shown in FIG. 9, stitching 34 may extend completely through fill material 26 near bottom end 20 to bisect bottom end 20. The use of such stitching 34 is advantageous in reducing the height of head pillow 12 at bottom end 20 and to help prevent the fill material from shifting around within fabric shell 24.

The dimensions of head pillow 12 (as well as of leg pillow 14 and torso pillow 16) are critical in certain embodiments in insuring that proper support and comfort is provided to the various body parts of the user. For example, in one embodiment, head pillow 12 may have a maximum width, $W_1$, near top end 18 that is in the range from about 12 inches to about 24 inches, and typically around 17 inches. The width, $W_2$, at bottom end 20 may be in the range from about 6 inches to about 12 inches, and typically around 9 inches. Head pillow 12 may also include a lateral length, $L_1$, from top end 18 to bottom end 20 in the range from about 20 inches to about 36 inches, and typically about 28 inches. Head pillow 12 may also include a longitudinal length, $L_2$, from top end 18 to bottom end 20 in the range from about 12 inches to about 25 inches, and more typically about 20 inches. As best shown in FIG. 10, head pillow 12 may have a height, $H_1$, at top end 18 that is in the range from about 2 inches to about 10 inches, and more typically about 6 inches, a maximum height, $H_2$, between top end 18 and bottom end 20 in the range from about 5 inches to about 12 inches, and more typically about 8 inches, and a height $H_3$, at bottom end 20 in the range from about 1 inches to about 5 inches, and more typically about 3 inches. As described hereinafter, such dimensions are critical in supporting the head, typically in combination with the other pillows of pillow system 10. For example, head pillow 12 may conveniently be thought of in terms of a head region 36 and a neck region 38. Neck region 38 may be disposed at an angle, $A_1$, that is in the range from about 35 degrees to about 65 degrees, and more typically about 50 degrees relative to head region 36.

Figure 6:
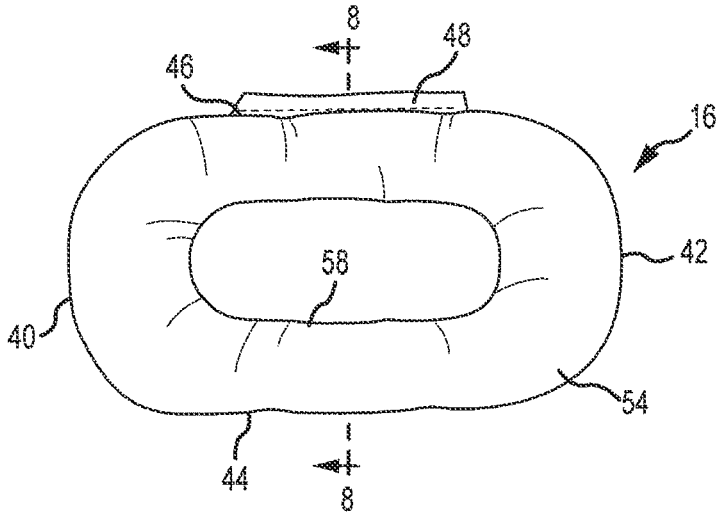
FIG. 6 is a top view of the torso pillow of FIG. 1.
Figure 7:
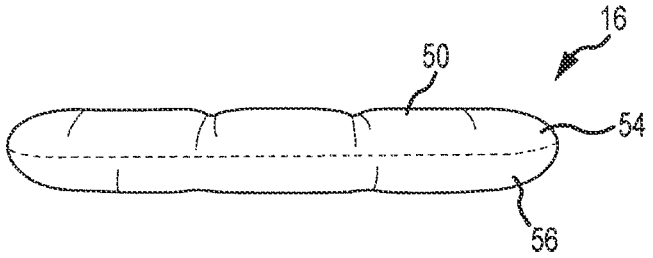
FIG. 7 is a side view of the torso pillow of FIG. 6.
Figure 8:
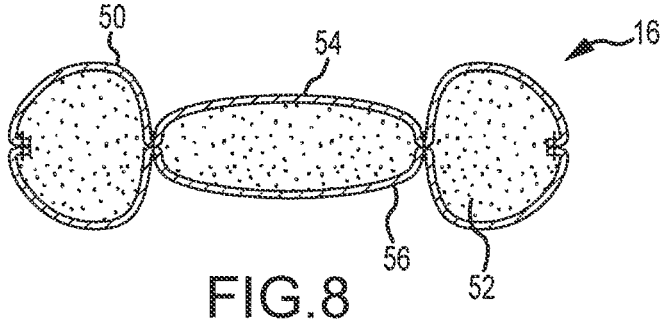
FIG. 8 is a cross-sectional side view of the torso pillow of FIG. 6 taken along lines 8-8.

Referring now to FIGS. 3 and 6-8, torso pillow 16 will be described in greater detail. Torso pillow is generally rectangular in geometry (with rounded corners) and may be defined in terms of ends 40 and 42 and sides 44 and 46. A connector material 48 may conveniently extend from side 46 and may comprise a strip of hook and loop fastener material. Alternatively, any of the connectors described herein could also be used. As best shown in FIG. 8, torso pillow 16 may be constructed of a fabric shell 50 that encases a fill material 52. Shell 50 and fill material 52 may be similar to those used in connection of head pillow 12 or any of the other materials described herein. Conveniently, shell 50 may be constructed of a top piece 54 and a bottom piece 56 that are sewn together using thread. Also, as best shown in FIG. 6, a length of stitching 58 may be completely sewn through shell 50 and fill material 52 in order to provide pillow 16 with the cross-sectional shape shown in FIG. 8 as well as to keep the fill material 52 from shifting around within shell 50. This stitching also allows the center to be stuffed firmer than the outside ring. Typically, stitching 58 will be placed a few inches from the outer periphery of torso pillow 16. Also, it will be appreciated that other stitching patterns could be used.

In one particular aspect, torso pillow 16 may have a length between ends 40 and 42 that is in the range from about 14 inches to about 26 inches, and more typically about 20 inches. The width from side 44 to side 46 may be in the range from about 6 inches to about 14 inches, and typically about 11.5 inches. The outer height (as shown in FIG. 8) may be in the range from about 1 inches to about 5 inches, and more typically about 3.5 inches. The interior height may be in the range from about 0.5 inches to about 4 inches, and more typically about 2 inches. Such a height is particularly useful when torso pillow 16 is used to support a person's stomach, and more particularly the stomach of a woman that may be extended due to a pregnancy.

Figure 5:
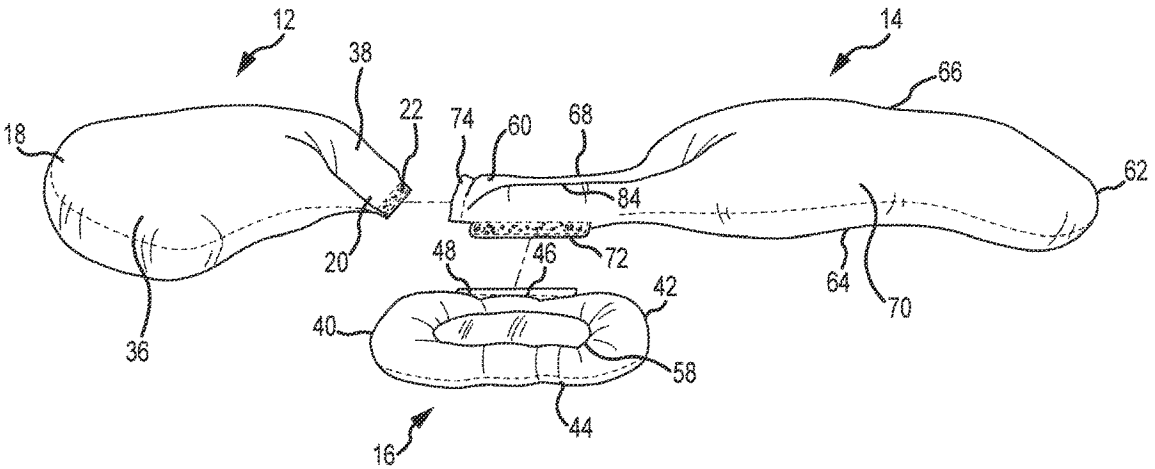
FIG. 5 illustrates the pillow system of FIG. 1, with the head, torso, and leg pillows being separated from each other.

Referring now to FIGS. 4 and 12-14, construction of leg pillow 14 will be described in greater detail. Leg pillow 14 may be conveniently defined in terms of a top end 60, a bottom end 62 and sides 64 and 66. Also, leg pillow 14 may also be defined in terms of a generally straight upper section 68 and a leg section 70 (also referred to as a lower section). Leg pillow 14 may also include a connector material 72 alongside 64 as well as a length of connector material 74 at top end 60. In the configuration illustrated in FIG. 1, and as best illustrated in FIG. 5, connector material 72 permits leg pillow 14 to be coupled to torso pillow 16 using connector material 48.

Also, connector material 74 permits leg pillow 14 to be coupled to head pillow 12 using connector material 22. Connector material 72 and connector material 74 may comprise a hook and loop fastener material to permit them to be coupled to connector materials 48 and 22, respectively. However, other connector materials as described herein, as well as other connection mechanisms, may be used. Conveniently, the connector materials may be included on a strip of fabric that extends from each of the pillows described herein to permit them to be coupled to the connector materials on the adjoining pillows. For example, one connector material could be placed on the top side of a strip of fabric that extends from one pillow while another connector material may be placed on the bottom side of a strip of fabric that extends from an adjacent pillow to permit them to be easily coupled together. Also, as described hereinafter, it will be appreciated that the various pillows of pillow system 12 may be coupled to any of the pillows in the system and the invention is not intended to be limited to the configuration illustrated in FIG. 1.

Figure 14:
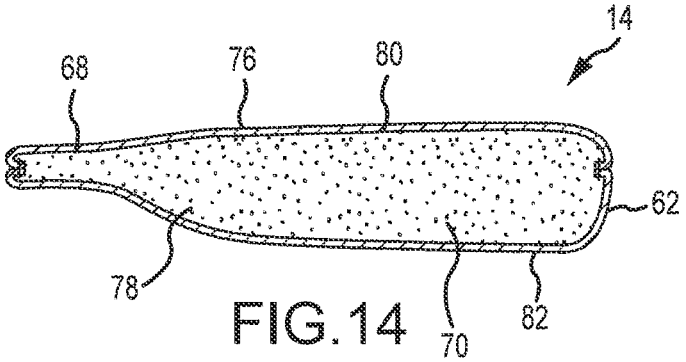
FIG. 14 is a cross-sectional side view of the leg pillow of FIG. 12 taken along lines 14-14.

In one aspect, upper section 68 of leg pillow 14 may have a length in the range from about 6 inches to about 18 inches, and more typically about 13 inches. The width of upper section 68 may be in the range from about 3 inches to about 10 inches, and more typically about 7 inches. The height or thickness of upper section 68 as illustrated in FIG. 14 may be in the range from about 1 inches to about 5 inches, and more typically about 3.5 inches. Leg section 70 (also referred to as a lower section) may have a lateral length, $L_3$, that is in the range from about 30 inches to about 40 inches, and more typically about 35 inches, and a width, $W_4$, in the range from about 10 inches to about 18 inches, and more typically about 14 inches. The average height of leg section 70 as illustrated in FIG. 14 may be in the range from about 3 inches to about 9 inches, and more typically about 6 inches. Hence, the entire length, $L_4$, of leg pillow 14 may be in the range from about 40 inches to about 56 inches, and more typically about 48 inches. Also, leg pillow 14 may have a lateral width from bottom end 62 to side 66, $W_5$, that is in the range from about 20 inches to about 32 inches, and more typically about 25 inches. Further, leg section 70 may be positioned at an angle relative to straight upper section 68. This angle may be defined in terms of the line defining $W_5$ and the line defining $L_4$ and may be in the range from about 15 degrees to about 50 degrees, and more typically about 35 degrees.

As best shown in FIG. 14, leg pillow 14 may be constructed from a fabric shell 76 encasing a fill material 78. Shell 76 may conveniently be constructed from a top piece of fabric 80 and a bottom piece of fabric 82. Top piece 80 may be connected to bottom piece 82 by sewing them together. Any of the fabrics and/or fill materials previously described herein may be used to construct shell 76 and fill material 78.

Figure 12:
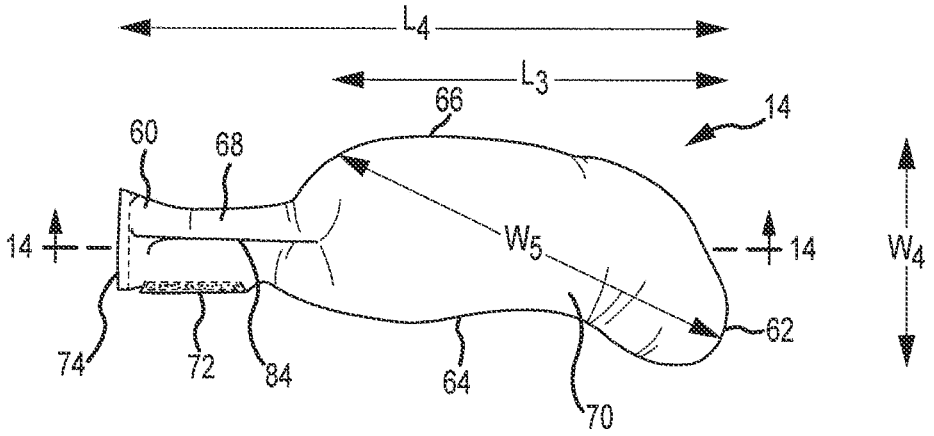
FIG. 12 is a top view of the leg pillow of FIG. 1.
Figure 13:
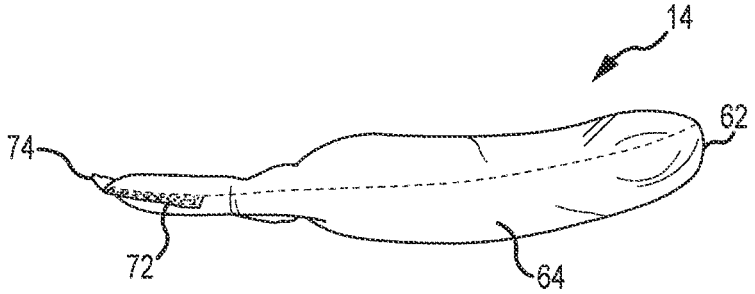
FIG. 13 is a side view of the leg pillow of FIG. 12.

As best shown in FIG. 12, stitching 84 may be used to bisect upper section 68 by sewing completely through shell 76 and fill material 78. Stitching 84 is employed to keep the fill material from shifting as well as to provide an appropriate shape and height to upper section 68.

As best illustrated in FIG. 19, the particular shapes and dimensions of head pillow 12, leg pillow 14 and torso pillow 16 are especially useful in producing the overall shape and size of pillow system 10. For example, pillow system 10 may conveniently be described in terms of a C shape, with head region 36 and leg section 70 forming the end of the C. The central part of the C is formed by upper section 68 of leg pillow 14. Torso pillow 16 sits within the center of the C shaped configuration formed by head pillow 12 and leg pillow 14. The configuration is made possible in part by the angling of head pillow 12 and leg pillow 14 as previously described. These angles are selected so that head pillow 12 and leg pillow 14 will be appropriately positioned relative to a user during certain uses as described hereinafter. For example, this configuration is particularly suited for the uses illustrated in FIGS. 15 and 16 as will be described hereinafter.

Figure 15:
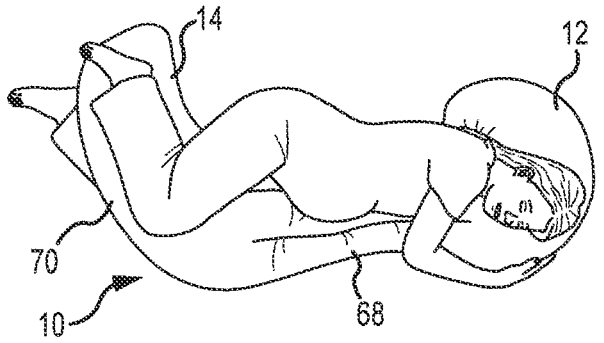
FIG. 15 illustrates one exemplary use of the pillow system of FIG. 1.
Figure 16:
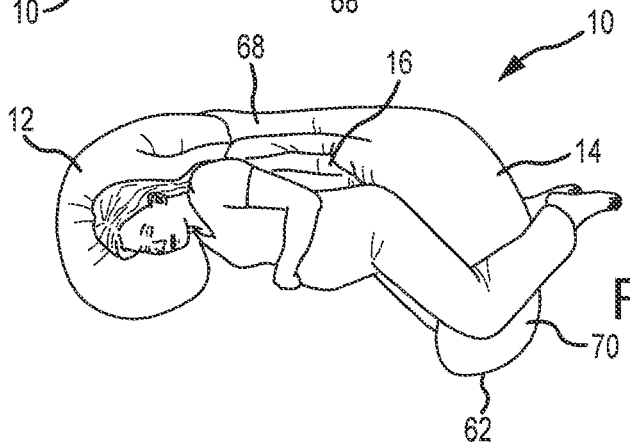
FIG. 16 illustrates another use of the pillow system of FIG. 1.

Also, as illustrated in the side view of FIG. 20, the various height dimensions of the pillows within pillow system 10 vary in order to accommodate the different body parts of the user. For example, the upper section 68 of leg pillow 14 has a reduced height where torso pillow 16 may be coupled. This configuration is particularly useful when torso pillow 16 is used to support a user's lower back or stomach as illustrated in FIGS. 15 and 16. More specifically, in the embodiment shown in FIG. 15, a user is lying on pillow system 10 which includes all three pillows (as illustrated in FIG. 19). Head pillow 12 is being used to support the user's head while leg pillow 14 is positioned between the user's legs to support the user's hips and thighs. As shown, the user is a pregnant mother whose stomach rests upon torso pillow 16, which is hidden from view by the user's stomach. In some cases, the user's stomach may extend past torso pillow 16 and may also be somewhat supported by upper section 68 of leg pillow 14. Hence, in the arrangement illustrated in FIG. 15, a user's spine may be aligned, with the user's head being appropriately supported by head pillow 12, while the user's hips are supported by leg pillow 14. At the same time, the user's stomach is supported by torso pillow 16.

In the embodiment of FIG. 16, all three pillows of pillow system 10 are employed, but the user has torso pillow 16 positioned against the lower back while upper section 68 of leg pillow 14 extends along the user's back (instead of the user's stomach as illustrated in FIG. 15). In this way, pillow system 10 may be used to provide support to the user's lower back while also supporting the head using head pillow 12. At the same time, the user's hips and thighs are supported using leg pillow 14 as previously described in connection with FIG. 15.

In some cases, a user may wish to utilize pillow system 10 in the positions illustrated in FIGS. 15 and 16, but without the use of torso pillow 16. This configuration is illustrated in FIG. 21 where torso pillow 16 has been removed. A user may lie on pillow system 10 in the configuration of FIG. 21 in a manner similar to that shown in FIGS. 15 and 16. In such cases, upper section 68 of leg pillow 14 may still provide some support to the user's stomach and/or lower back depending on how the user lays on pillow system 10.

Figure 17:
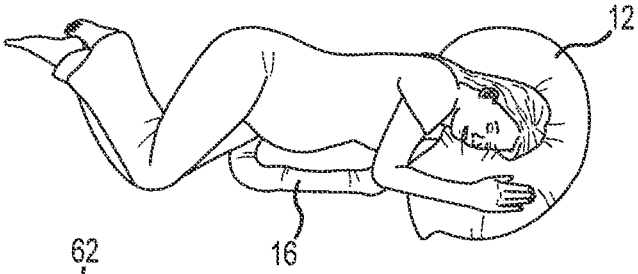
FIG. 17 illustrates use of the head and torso pillows of FIG. 1.

FIG. 17 illustrates an embodiment where head pillow 12 and torso pillow 14 are being used to support a woman lying on her side. In such cases, pillows 12 and 14 could be removably coupled together. Alternatively, pillows 12 and 14 may be placed adjacent each other, but not connected together. As illustrated in FIG. 17, the user's head is supported by head pillow 12 while the stomach is supported using torso pillow 14 in a manner somewhat similar to the embodiment illustrated in FIG. 15, except that leg pillow 14 is not utilized.

Figure 18:
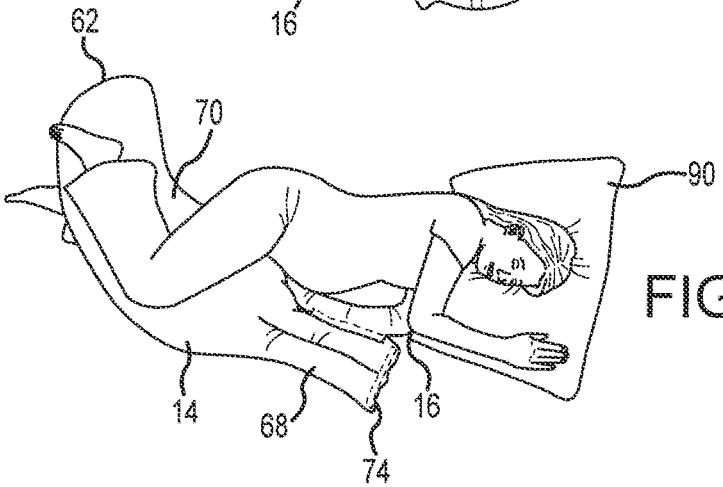
FIG. 18 illustrates one use of the leg and torso pillows of FIG. 1 along with a traditional head pillow.

FIG. 18 illustrates one embodiment where leg pillow 14 is coupled to torso pillow 16, with leg pillow 14 being placed between the user's knees and thighs while torso pillow 16 is positioned beneath the user's stomach. This position is somewhat similar to the position illustrated in the embodiment of FIG. 15, except that head pillow 12 is not used. Instead, the user may wish to utilize a traditional head pillow 90 as shown. Head pillow 90 may be any conventional type of pillow, is typically square or rectangular in shape, and is filled with a fill material, such as a polyester fill or feathers. The arrangement of FIG. 18 is particularly useful in cases where a user is comfortable with her own pillow yet still needs some stomach and hip support. As such, the user can utilize pillows 14 and 16 without head pillow 12.

As will be appreciated, a variety of other configurations and arrangements of the pillows in pillow system 10 may be used, and the invention is not intended to be limited to the specific uses illustrated in FIGS. 15-18. Rather, any combination or arrangement of pillows 12, 14 and 16 may be used depending on the particular need.

Figure 22:
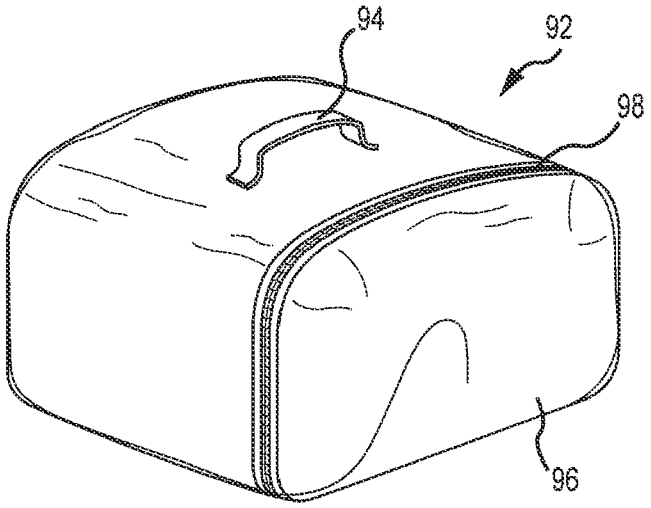
FIG. 22 illustrates an exemplary package for holding the pillow system of FIG. 1.

Referring now to FIG. 22, a package 92 is illustrated. Package 92 may be conveniently constructed of a clear material, such as plastic, that includes a handle 94 for convenient storage. Also, package 92 may include a side 96 that may be opened using a fastening mechanism, such as a zipper 98, in order to permit pillow system 10 to be inserted within package 92 and then closed using zipper 98. Use of a clear material to form package 92 is advantageous in that package 92 may be included on a shelf in a retail location to permit the user to visualize pillow system 10 that is contained within package 92. When ready to purchase (or to transport pillow system 10), the user may simply grasp handle 94.

The invention has now been described in detail for purposes of clarity and understanding. However, it will be appreciated that certain changes and modifications may be practiced within the scope of the appended claims.

What is claimed is:

1. A pillow system, comprising:

a body pillow, the body pillow comprising:

a head portion; and a leg portion, wherein:

the leg portion comprises an upper section and a lower section;

the upper section of the leg portion is between the head portion and the lower section;

the upper section of the leg portion is more narrow than the lower section of the leg portion and the head portion;

the upper section of the leg portion of the body pillow has a first height, the head portion has a second height, and the lower section of the leg portion has a third height;

the upper section comprises fill material;

the upper section comprises a length measured in a direction from the lower section of the leg portion to the head portion;

the upper section of the leg portion includes a length of stitching that longitudinally divides at least a portion of the upper section, wherein the length of stitching is along the length of the upper section measured in the direction from the lower section of the leg portion to the head portion; and the upper section is more narrow than the head portion and the lower section because the first height is less than the second height and the third height; and a torso pillow coupled with the body pillow.

2. The pillow system as recited in claim 1, wherein the head portion of the body pillow is removably attached to the upper section of the leg portion of the body pillow.

3. The pillow system as recited in claim 1, wherein the torso pillow is removably coupled with the body pillow.

4. The pillow system as recited in claim 1, wherein:

the upper section has a first width, the head portion has a second width, and the lower section has a third width; and the upper section is more narrow than the head portion and the lower section also because the first width is less than the second width and the third width.

5. The pillow system as recited in claim 4, wherein the second width is greater than the third width.

6. The pillow system as recited in claim 1, wherein the body pillow is curved.

7. The pillow system as recited in claim 1, wherein the head portion has a maximum width in the range from about 12 inches to about 24 inches, a lateral length in the range from about 20 inches to about 36 inches, and a maximum height in the range from about 5 inches to about 12 inches.

8. The pillow system as recited in claim 1, wherein the upper section of the leg portion is generally straight along its length, with a width in the range from about 3 inches to about 10 inches, a length in the range from about 6 inches to about 18 inches, and a height in the range from about 1 inch to about 5 inches.

9. The pillow system as recited in claim 1, wherein the leg portion has a longitudinal length in the range from about 40 inches to about 56 inches, and a lateral width from a bottom end to a far one side in the range from about 20 inches to about 32 inches.

10. The pillow system as recited in claim 1, wherein:

the torso pillow is generally rectangular in geometry with rounded corners; and the torso pillow has a length in the range from about 14 inches to about 26 inches, a width in the range from about 6 inches to about 14 inches, and a height in the range from about 1 inches to about 5 inches.

11. The pillow system as recited in claim 1, wherein the head portion is asymmetrical to the lower section of the leg portion.

12. The pillow system as recited in claim 1, wherein:

the torso pillow has a center and an outer ring divided by stitching; and the center is stuffed more firmly than the outer ring.

13. A pillow system, comprising:

a body pillow, the body pillow comprising:

a head portion for supporting a head of a person; and a leg portion, wherein:

the leg portion comprises an upper section and a lower section;

the upper section of the leg portion is between the head portion and the lower section;

the upper section comprises fill material;

the upper section of the leg portion of the body pillow has a first height;

the head portion has a second height;

the lower section of the leg portion has a third height;

the first height is less than the second height and the third height;

the upper section comprises a length measured in a direction from the lower section of the leg portion to the head portion;

the upper section of the leg portion includes a length of stitching that longitudinally divides at least a portion of the upper section along the length of the upper section; and the lower section of the leg portion is for supporting a leg of the person; and a torso pillow coupled with the body pillow, wherein when the pillow system is positioned against a user, the head portion is adjacent to a head of the user, the lower section of the leg portion is adjacent to a leg of the user, and the torso pillow is adjacent to a belly or a back of the user.

14. The pillow system as recited in claim 13, wherein the leg portion comprises connector material for removably coupling the head portion with the leg portion.

15. The pillow system as recited in claim 13, wherein the upper section of the leg portion comprises fill material that is continuous with fill material of the lower section of the leg portion.

16. The pillow system as recited in claim 13, wherein:

the person is a pregnant woman; and the upper section of the leg portion is configured to support the belly of the pregnant woman.

* * * * *